United States Patent [19]

Marangoni

[11] 4,122,886

[45] Oct. 31, 1978

[54] WINDOW SHADE TIE-DOWN SYSTEMS

[76] Inventor: Allen H. Marangoni, 3661 N. Decatur Rd., Decatur, Ga. 30031

[21] Appl. No.: 769,719

[22] Filed: Feb. 17, 1977

[51] Int. Cl.[2] ..... E06B 9/20

[52] U.S. Cl. ..... 160/269

[58] Field of Search ..... 160/269, 266, 277, 349, 160/328, 368 R; 248/505, 500; 24/71.1, 68 R, 68 CD; 254/79

[56] References Cited

U.S. PATENT DOCUMENTS

| | | | |
|---|---|---|---|
| 718,777 | 1/1903 | Lewison | 160/328 |
| 768,417 | 8/1904 | Woods | 160/269 |
| 1,241,425 | 9/1917 | Nelson | 160/269 |
| 1,498,594 | 6/1924 | Walson | 160/349 |
| 1,797,162 | 3/1931 | Stuber | 160/277 |
| 1,892,087 | 12/1932 | Stuber | 160/277 |
| 2,329,621 | 9/1943 | Johnson | 160/269 |
| 2,865,697 | 12/1958 | Staley | 248/500 |
| 3,128,106 | 4/1964 | Zinkel, Jr. | 24/68 CD |
| 3,323,772 | 6/1967 | DuPree et al. | 248/505 |
| 4,046,186 | 9/1977 | Nordstrom | 160/368 R |

*Primary Examiner*—Peter M. Caun

*Attorney, Agent, or Firm*—Robert B. Kennedy

[57] ABSTRACT

A tie-down system for holding the top and side edges of a shade to the top and sides of a window frame comprising a pair of brackets mounted to opposed upper corners of the window frame, a pair of clasps mounted to opposed lower corner of the window frame, a pair of swing arms pivoted to opposed lower corner of the frame for movement into and out of locking engagement with the clasps, and a flexible cord extending between the brackets and swing arms.

3 Claims, 2 Drawing Figures

WINDOW SHADE TIE-DOWN SYSTEMS

Figure 1:
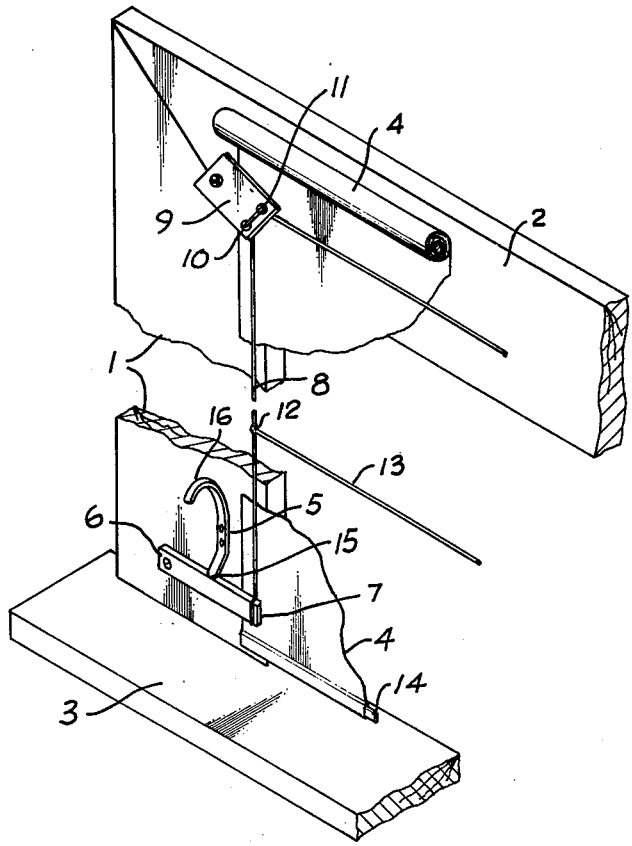

My invention relates to a window shade edge holder which is a continuous cord that is stretched tightly along the verticle outer edges of the window shade and across the top of the shade. Because of the position of, and the tension in the cord, said cord is able to force the shade against the frame of the window. The shade is the type which is mounted upon spring rollers and is greater in width than the inside edges of the frame of the window to which it is applied.

An object of the invention is to reduce the amount of heat transfer through the window. A further object is to reduce the amount of light permitted to enter through the window. Another object of the invention is to provide a shade sealer that is easily installed on the window frame. Another object of this invention is to provide a device which may be easily changed from its operative position against the shade to its inoperative position away from the shade, thereby permitting the shade to be raised when desired.

The foregoing objects and certain advantages that will hereinafter appear are realized in the embodiment of the invention illustrated in the accompanying drawing and described in detail below.

The drawing includes:

FIG. 1 which is an perspective view of a window with the window shade tie-down system attached and in the operative position.

Figure 2:
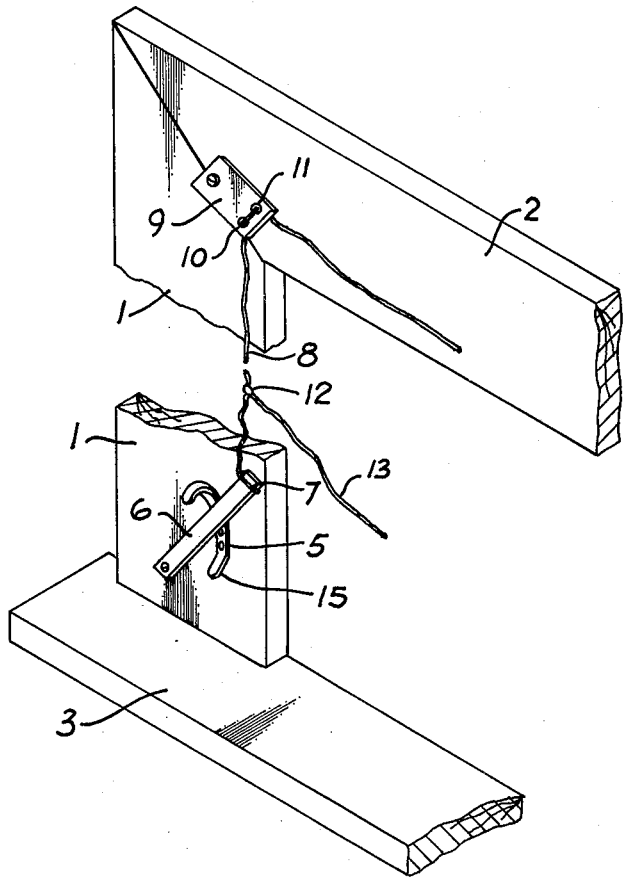

FIG. 2 which is an perspective view of a window with the window shade tie-down system attached and in the inoperative position.

In FIG. 1 of the drawing there is shown in elevation, a window casement. This window casement includes stile 1, an upper rail 2, and a window sill 3. Upon the upper rail 2 is a shade, 4, which is wider than the inside edge of stile 1, and long enough to traverse the length of the window from rail 2 to sill 3. The shade and mounting fixtures are old and will known in the art. At a position of one inch or less above the window sill 3, and less than one inch beyond the vertical edge of the shade 4, the clasp 5 is attached as shown in FIGS. 1 and 2. The arm 6 of the clasp 5 is attached to the window stile 1 so that the innermost part of the arm 7 is in a position that clamps the window shade 4 between the inner arm 7 and the stile 1, as is shown in FIG. 1. The arm is attached to the frame of the window (stile 1) in a manner which allows the pivotal movement of the arm 6. As shown in FIG. 1, the inside of arm 6 has attached to it a cord, 8, that leaves the shade side of the arm 6 and goes to the top bracket 9 on upper rail 2, as is shown in FIGS. 1 and 2. Said cord is threaded through the holes 10 and 11 in bracket 9, FIGS. 1 and 2. The thread is kept on the shade side of bracket 9 as is shown in FIGS. 1 and 2, while traversing the shade 4. A top bracket and bottem clasp are threaded in the same manner on the mirror image side, or left side of the window. The bracket 9 is attached to stile 1 so that it is released from its position of pressure against blind 4 when the entire unit is in its inoperative position as is shown in FIG. 2. In FIGS. 1 and 2 another cord is tied from position 12 to position 13 on cord 8. This cord from position 12 to 13 is for keeping line 8 on the inside edge of shade 4. Said cord, from position 12 to 13 on cord 8, may be attached further to stile 1 if additional strength is desired from cord 8.

When the device is in the operative position, as is shown in FIG. 1, the cord 8, is stretched from position 7 on arm 6, vertically and through holes 10 and 11 in bracket 9. Said cord 8 is then continued down the left side of the window in the same manner as was described for the right side of the window. This cord 8, thereby forces the edges of the blind 4 against the stile 1 and upper rail 2, thus providing the seal. Additionally, arm 6 on stile 1, presses the bottom slat of the shade 4, position 14, against sill 3 in FIG. 1.

In FIG. 1, the arm 6 is held against the shade 4, by slot 15 which holds the arm 6 in place on stile 1. To raise the shade 4, the arm 6 must first be placed in the inoperative position as is shown in FIG. 2. The curve 16 in clasp 5 holds arm 6 out from the shade 4 when arm 6 is released from slot 15. Because the total distance that cord 8 must be stretched is reduced, the tension in, and or on, cord 8, upper bracket 9, and the mirror image side of FIG. 1 is also reduced. This reduction in tension permits the bracket 9 to reduce its force against shade 4 and facilitates the raising of the shade 4. To lower shade 4 and make the window shade tie-down system operative again, the obvious reverse procedure is used. In each step described, the same process is repeated on the mirror immage side of the window as is done with the side shown and described.

From the foregoing description of the invention illustrated in the drawing, it will be apparent that by this invention there is provided a device that secures the shade flat against the window frame and thereby reduces the amount of heat transferred through the window. When desired, the shade may be easily raised to permit sun light or heat to pass through the window. It is obvious that the invention may be made of many different materials without loosing its effectiveness. It will also be obvious that various changes may be made by those skilled in the art, in the details of the embodiment of the invention illustrated in the drawings and described above within the principle and scope of the invention as expressed in the appended claims.

I claim:

1. A tie-down system for holding the top and side edges of a shade to the top and sides of a window frame and with said tie-down system comprising a pair of brackets mounted to opposed upper corners of the window frame with portions of said brackets bearing cord guides overlaying the side of the shade distal said frame; a pair of clasps mounted to opposed lower corner of the window frame aside and straddling the shade; a pair of swing arms pivotably mounted to opposed lower corner of the window frame overlaying the side of said shade distal said window frame for movement into and out of locking engagement with said clasps; and flexible cord means extending between said swing arms through said pair of bracket cord guides.

2. A tie-down system in accordance with claim 1 wherein said cord guides are defined by holes through said brackets.

3. A tie-down system in accordance with claim 1 wherein each of said clasp is of arcuate shape with a midportion thereof rigidly mounted to said window frame, and wherein each of said swing arms is pivotably mounted to said window frame for alternate movement over the sides of said clasp proximal and distal the window frame.

* * * * *